United States Patent [19]

Nunnery et al.

[11] Patent Number: 4,468,817

[45] Date of Patent: Sep. 4, 1984

[54] PERSPIRATION BAND FOR HEADGEAR

[76] Inventors: Merle W. Nunnery; Judith Noel, both of 602 Franklin St., Gretna, La. 70053

[21] Appl. No.: 542,457

[22] Filed: Oct. 17, 1983

[51] Int. Cl.[3] ..... A42B 00/00; A42C 5/00

[52] U.S. Cl. ..... 2/181; 2/181.6; 2/DIG. 11; 2/414

[58] Field of Search ..... 2/181, 181.6, DIG. 11, 2/414

[56] References Cited

U.S. PATENT DOCUMENTS

| | | | |
|---|---|---|---|
| 2,136,678 | 11/1936 | Dym | 2/181 |
| 2,159,681 | 3/1937 | Wisman | 2/181 |
| 2,359,387 | 10/1944 | Riddell | 2/181 |
| 2,557,123 | 8/1945 | Lyon | 2/181.8 |
| 2,617,988 | 3/1950 | Alesi | 2/181 |
| 2,981,955 | 10/1957 | Ruggiero | 2/181 |

FOREIGN PATENT DOCUMENTS

| | | | |
|---|---|---|---|
| 124654 | 3/1919 | United Kingdom | 2/181 |

*Primary Examiner*—Louis K. Rimrodt
*Assistant Examiner*—Mary A. Ellis

[57] ABSTRACT

This perspiration band provides for more comfortable wearing and non-allergic reaction for its user, when attached to the existing band of a safety hat or other headgear. Primarily, it consists of a washable terrycloth strip, which includes snap fasteners for attachment to the existing hat band.

1 Claim, 3 Drawing Figures

PERSPIRATION BAND FOR HEADGEAR

BACKGROUND OF THE INVENTION

The field of this invention relates to articles for headgear, and more particularly, a perspiration band for headgear.

The principal object of this invention is to provide a perspiration band for headgear, which will be employed in safety hats, so as to provide greater comfort for the wearer than may be had with the existing band of the hat.

SUMMARY OF THE INVENTION

The prior art of this invention indicates that workers in many industries such as building construction, oil well drilling and the like are required to wear safety helments generally termed as "hard hats". These hard hats are uncomfortable and also disagreeable to wear due to odor from perspiration collected therein.

Another object of this invention is to provide a perspiration band for headgear, which will not give its user an allergic reaction, as occurs with leather and some other materials.

Another object of this invention is to provide a perspiration band for headgear, which will be easy to remove for regular washing, and it also will serve to prevent safety hats from blowing off of the wearer's head.

A further object of this invention is to provide a perspiration band for headgear, which will snap in and out of safety hats of both styles.

A still further object of this invention is to provide a perspiration band for headgear, which will also be adaptable for welding shields, and other forms of headgear.

Other objects are to provide a perspiration band for headgear, which is simple in design, inexpensive to manufacture, rugged in construction, easy to use, and efficient in operation.

These, and other objects, will be readily evident, upon a study of the following specification, and the accompanying drawing, wherein:

FIG. 1 is a plan view of the present invention;

FIG. 2 is a plan view of a modified form of the invention, and

FIG. 3 is a fragmentary side elevational view of FIG. 1, shown secured to an existing safety hat band.

BRIEF DESCRIPTION OF THE DRAWINGS

Accordingly, a perspiration band 10 is shown to include a rectangular configurated strip 11, which is fabricated of a suitable terrycloth material, that is easily washed, so as to be sanitary. A plurality of equally spaced-apart male snap fasteners 12 are fixedly secured near the top longitudinal side edge 13 of strip 11, and a similar number of female snap fasteners 14 are similarly secured near the bottom longitudinal edge 15 of strip 11, so as to fasten band 10 to a four strap 16 band 17 of a safety hat (not shown).

In use, band 10 is fastened to strap 17, by snappably engaging fasteners 12 and 14 to their mating fasteners of existing band 17, and the result is, that strip 11 engages with the forehead and sides of the head of the wearer, and it shall be noted, that band 10 is provided for the four strap band 17 of a safety hat.

Figure 1:
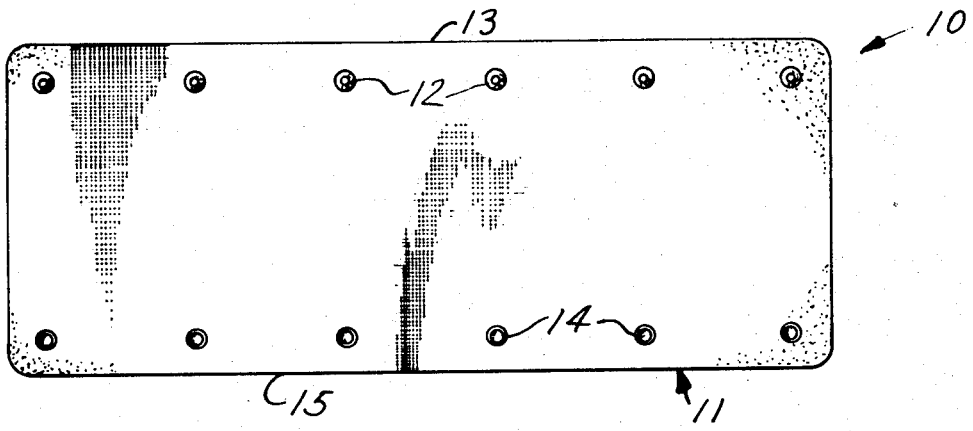
Figure 2:
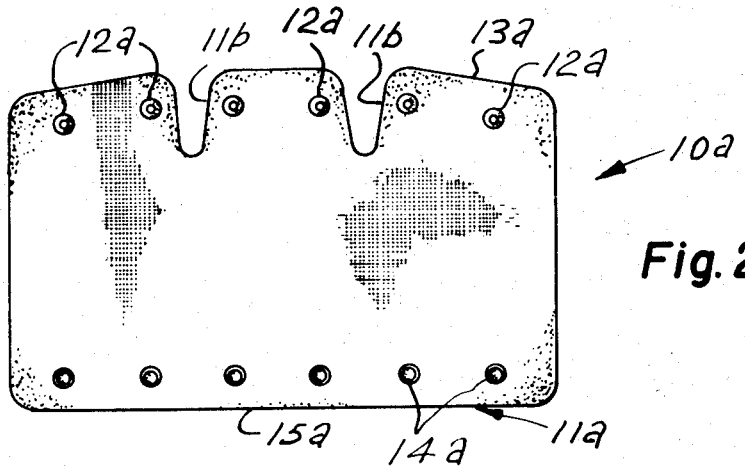
Referring now to FIG. 2, a modified band **10*a* is provided for a six strap band, which is used in another model of safety hat, and band 10*a* includes a strip 11*a*, also of terrycloth material, as was heretofore described of strip 11. Strip 11*a* is provided with male fasteners 12*a*, which are fixedly secured near the top longitudinal edge 13*a*, and female fasteners 14*a* are fixedly secured near the bottom longitudinal edge 15*a* of strip 11*a*. Strip 11*a* also includes a pair of cut-outs 11*b* in the top longitudinal edge 13*a***, so as to adapt it to the six strap band (not shown) of the modified safety hat.
Figure 3:
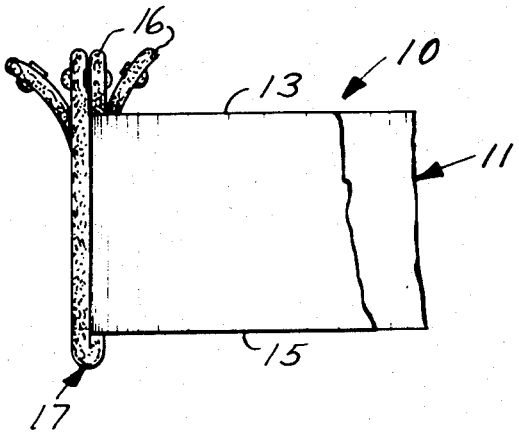

In use, band **10*a* is fastened to the modified safety hat, in the same manner heretofore described of band 10**.

While various changes may be made in the detail construction, it is understood that such changes will be within the spirit and scope of the present invention, as is defined by the appended claims.

We claim:

1. A perspiration band for headgear, comprising, in combination, a rectangular-shaped strip of washable terrycloth material, a plurality of spaced-apart male snap fastener elements fixedly secured near a top longitudinal side edge of said strip and a like plurality of female snap fastener elements near a bottom longitudinal edge of said strip, and said top longitudinal side edge including a plurality of cut-out notches dividing said edge into a plurality of tabs each of which contains a pair of said male snap fastener elements so as to adapt fastening said perspiration band to a conventional six strap headband of a safety hat.

* * * * *